US012650131B2

(12) United States Patent
Lefrancois et al.

(10) Patent No.: US 12,650,131 B2
(45) Date of Patent: Jun. 9, 2026

(54) COMPOSITE CROSS-OVER DIFFUSER FOR A CENTRIFUGAL PUMP, CENTRIFUGAL PUMP COMPRISING THE SAME AND CORRESPONDING MANUFACTURING PROCESS

(71) Applicant: WATERAX INC., Montreal (CA)

(72) Inventors: Frederic Lefrancois, Montreal (CA); Norith Tan, Montreal (CA); Rabih Bouyakdan, Montreal (CA); Jonathan Bousquet, Montreal (CA); Raffaele Gerbasi, Montreal (CA)

(73) Assignee: WATERAX INC., Montreal (CA)

( * ) Notice: Subject to any disclaimer, the term of this patent is extended or adjusted under 35 U.S.C. 154(b) by 0 days.

(21) Appl. No.: 18/685,698

(22) PCT Filed: Aug. 25, 2022

(86) PCT No.: PCT/CA2022/051287
§ 371 (c)(1),
(2) Date: Feb. 22, 2024

(87) PCT Pub. No.: WO2023/023862
PCT Pub. Date: Mar. 2, 2023

(65) Prior Publication Data

US 2024/0360840 A1 Oct. 31, 2024

Related U.S. Application Data

(60) Provisional application No. 63/260,542, filed on Aug. 25, 2021.

(51) Int. Cl.

| | |
|---|---|
| ***F04D 29/44*** | (2006.01) |
| ***F04D 1/06*** | (2006.01) |
| ***F04D 29/02*** | (2006.01) |

(52) U.S. Cl.
CPC ..... *F04D 29/444* (2013.01); *F04D 1/06* (2013.01); *F04D 29/026* (2013.01)

(58) Field of Classification Search
CPC .... F04D 29/445; F04D 29/448; F04D 29/444; F04D 29/026; F04D 1/06
See application file for complete search history.

(56) References Cited

U.S. PATENT DOCUMENTS 1,837,873 A * 12/1931 Macmeeken ..... F04D 1/063 415/105
2,851,956 A 9/1958 Lung
(Continued)

FOREIGN PATENT DOCUMENTS

JP 2016108956 A 6/2016
JP 6771663 B2 10/2020

OTHER PUBLICATIONS

International Search Report and Written Opinion filed in PCT/CA2022/051287 dated Nov. 23, 2022; 6 pgs.
(Continued)

*Primary Examiner* — Michael K. Reitz
(74) *Attorney, Agent, or Firm* — Vedder Price P.C.

(57) ABSTRACT

The present disclosure concerns a composite diffuser for a centrifugal pump, the composite diffuser comprising a diffuser housing assembly at least partially delimiting an impeller shaft-receiving opening and having upstream and downstream sides, the diffuser housing assembly being at least partially formed in a first material; and a plurality of vanes mounted to or formed integral with the upstream side of the diffuser housing assembly and protruding therefrom, at least one of the plurality of vanes comprising a reinforcing vane portion formed in a second material different from the
(Continued)

first material. It also concerns a centrifugal pump comprising such a composite diffuser, and a process for manufacturing a composite diffuser.

13 Claims, 9 Drawing Sheets

(56) References Cited

U.S. PATENT DOCUMENTS

| | | | | |
|---|---|---|---|---|
| 3,986,791 | A * | 10/1976 | Paciga | F04D 1/06 415/199.2 |
| 4,669,952 | A | 6/1987 | Forsyth, III et al. | |
| 6,568,904 | B1 * | 5/2003 | Ueyama | F04D 29/668 415/199.2 |
| 6,607,353 | B2 * | 8/2003 | Masutani | F04D 29/462 415/208.4 |
| 6,749,397 | B2 * | 6/2004 | Ueyama | F04D 17/125 415/214.1 |
| 6,979,174 | B2 | 12/2005 | Watson et al. | |
| 7,290,984 | B2 | 11/2007 | Volk | |
| 8,403,639 | B2 | 3/2013 | Vedsted et al. | |
| 8,511,981 | B2 | 8/2013 | Small et al. | |
| 9,175,594 | B2 | 11/2015 | Schaffer et al. | |
| 9,683,571 | B2 | 6/2017 | Morrison et al. | |
| 10,309,362 | B2 | 6/2019 | Behringer et al. | |
| 10,329,994 | B2 | 6/2019 | Rieber et al. | |
| 10,349,809 | B2 | 7/2019 | Dries et al. | |
| 10,780,665 | B2 | 9/2020 | Skocypec et al. | |
| 10,941,779 | B2 | 3/2021 | Ye et al. | |
| 11,643,911 | B2 | 5/2023 | Radov et al. | |
| 2006/0269404 | A1 | 11/2006 | Volk | |
| 2007/0274828 | A1 * | 11/2007 | Fukuki | F04D 13/0673 415/199.1 |
| 2009/0047119 | A1 | 2/2009 | Bookout et al. | |
| 2010/0008768 | A1 | 1/2010 | Vedsted et al. | |
| 2012/0014801 | A1 | 1/2012 | Small et al. | |
| 2014/0294575 | A1 | 10/2014 | Morrison et al. | |
| 2019/0176426 | A1 | 6/2019 | Skocypec et al. | |
| 2019/0271217 | A1 | 9/2019 | Radov et al. | |
| 2024/0141918 | A1 | 5/2024 | Nobel | |

OTHER PUBLICATIONS

Supplementary European Search Report issued in Application No. EP 22 85 9747, dated Jun. 11, 2025; 6 pgs.

Chile Examination Report issued on Feb. 18, 2025, 38 pgs. See page 3 for list of cited references in English.

* cited by examiner

COMPOSITE CROSS-OVER DIFFUSER FOR A CENTRIFUGAL PUMP, CENTRIFUGAL PUMP COMPRISING THE SAME AND CORRESPONDING MANUFACTURING PROCESS

PRIOR APPLICATION

The present application claims priority of PCT/CA2022/051287, filed on Aug. 25, 2022, which claims benefit from U.S. provisional patent application No. 63/260,542, filed on Aug. 25, 2021, and entitled "COMPOSITE DIFFUSER FOR A CENTRIFUGAL PUMP, CENTRIFUGAL PUMP COMPRISING THE SAME AND CORRESPONDING MANUFACTURING PROCESS", the disclosure of which being hereby incorporated by reference in its entirety.

TECHNICAL FIELD

The technical field relates to diffusers for centrifugal pumps, and more particularly to composite cross-over diffusers for multi-staged centrifugal pumps, to centrifugal pumps comprising the same and to corresponding manufacturing processes.

BACKGROUND

In a variety of environments, centrifugal pumps are used to move fluids. For instance, fire centrifugal pumps are used to pump water from a body of water and direct the water to a specific area. However, such pumps usually undergo high mechanical constraints and/or are used in extreme usage conditions, so that their components might get damaged or destroyed, thus jeopardizing the use of the pump.

In view of the above, there is a need for a centrifugal pump which would be able to overcome or at least minimize some of the above-discussed prior art concerns.

BRIEF SUMMARY

It is therefore an aim of the present invention to address the above-mentioned issues.

According to a general aspect, there is provided a composite cross-over diffuser for a centrifugal pump, the composite cross-over diffuser comprising: a diffuser housing assembly at least partially delimiting an impeller shaft-receiving opening and being at least partially formed in a first material; and a vane-reinforcing assembly comprising a plurality of vanes mounted to or formed integral with the diffuser housing assembly and protruding therefrom, the plurality of vanes comprising at least one reinforcing vane portion formed in a second material different from the first material.

According to another general aspect, there is provided a composite cross-over diffuser for a centrifugal pump, the composite cross-over diffuser comprising: a casing-mounting member having an impeller shaft-receiving opening and comprising a core-supporting portion; and a composite diffuser core mounted to or at least partially formed integral with the core-supporting portion of the casing-mounting member; wherein the composite diffuser core comprises: a core body at least partially formed in a first material and having upstream and downstream faces; and a plurality of vanes comprising a plurality of upstream vane members mounted to or formed integral with the upstream face of the core body and protruding therefrom, at least one of the plurality of upstream vane members comprising a reinforcing vane portion formed in a second material different from the first material.

According to another general aspect, there is provided a composite cross-over diffuser for a centrifugal pump, the composite cross-over diffuser comprising: a diffuser housing assembly at least partially delimiting an impeller shaft-receiving opening and having upstream and downstream sides, the diffuser housing assembly being at least partially formed in a first material; and a plurality of vanes mounted to or formed integral with the upstream side of the diffuser housing assembly and protruding therefrom, at least one of the plurality of vanes comprising a reinforcing vane portion formed in a second material different from the first material.

According to another general aspect, there is provided a composite cross-over diffuser for a centrifugal pump, the composite cross-over diffuser comprising: a casing-mounting member having an impeller shaft-receiving opening and comprising a core-supporting portion; and a composite diffuser core secured to the core-supporting portion of the casing-mounting member. The composite diffuser core comprises: a core body being at least partially formed in a first material and having upstream and downstream faces; and a plurality of vanes mounted to or formed integral with the upstream face of the core body and protruding therefrom, at least one of the plurality of vanes comprising a reinforcing vane portion formed in a second material different from the first material.

According to another general aspect, there is provided a multi-staged centrifugal pump comprising: an outer housing; a plurality of diffusers fixedly mounted to the outer housing; and a plurality of impellers rotatably mounted to the outer housing, at least one of the plurality of impellers being arranged between two adjacent diffusers. The plurality of diffusers comprises at least one composite cross-over diffuser according to the present disclosure.

According to another general aspect, there is provided a process for manufacturing a composite cross-over diffuser, comprising: providing a diffuser housing assembly at least partially formed in a first material; providing a vane-reinforcing assembly comprising a plurality of vanes, the plurality of vanes comprising at least one reinforcing vane portion formed in a second material different from the first material; and securing the vane-reinforcing assembly to the diffuser housing assembly to form the composite cross-over diffuser.

In some embodiments, the diffuser housing assembly has upstream and downstream sides, the process comprising securing the vane-reinforcing assembly to the upstream side of the diffuser housing assembly.

In some embodiments, the process further comprises providing a casing-mounting member; providing a core body at least partially formed in the first material; and securing the core body to the casing-mounting member so as to form the diffuser housing assembly.

In some embodiments, a plurality of core-receiving apertures are formed in an upstream side of the casing-mounting member and the core body has upstream and downstream faces and a plurality of diffuser housing-mounting pins mounted to or formed integral with the downstream face, the process comprising at least partially engaging the plurality of diffuser housing-mounting pins with the plurality of core-receiving apertures to secure the core body to the casing-mounting member.

In some embodiments, the core body is welded to the casing-mounting member.

In some embodiments, the core body is welded via sonic welding or ultra-sonic welding to the casing-mounting member.

In some embodiments, the core body comprises a core plate and a plurality of distal upstream vane portions mounted to or formed integral with an upstream face of the core plate, the vane-reinforcing assembly comprising a plurality of reinforcing vane portions, the process comprising overmolding at least partially the plurality of reinforcing vane portions onto the plurality of distal upstream vane portions.

According to another general aspect, there is provided a process for manufacturing a composite cross-over diffuser, comprising: providing a core body having an upstream face, the core body being at least partially formed in a first material; providing a vane-reinforcing assembly at least partially formed in a second material; securing the vane-reinforcing assembly to the upstream face of the core body to form a composite diffuser core; providing a casing-mounting member; and securing the composite diffuser core to the casing-mounting member.

DETAILED DESCRIPTION

Figure 1:
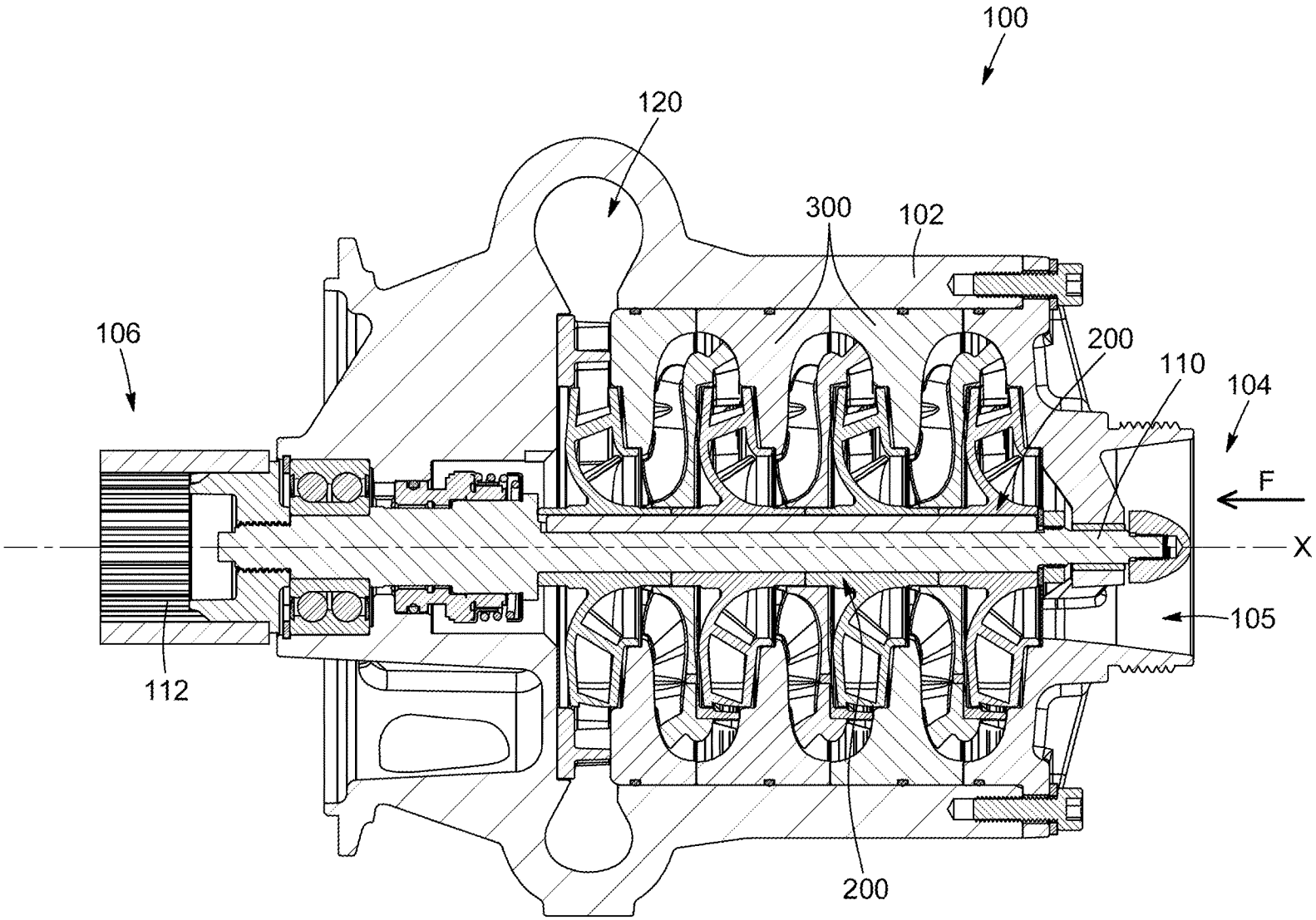
FIG. 1 is a cross-sectional view of a centrifugal pump comprising an outer housing, a pump shaft, a plurality of impellers fixedly mounted to the pump shaft and a plurality of composite diffusers in accordance with an embodiment, the plurality of composite diffusers being fixedly mounted to the outer housing.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Moreover, it will be appreciated that positional descriptions such as "above", "below", "forward", "rearward", "left", "right" and the like should, unless otherwise indicated, be taken in the context of the figures only and should not be considered limiting. Moreover, the figures are meant to be illustrative of certain characteristics of the centrifugal pump and the components thereof and are not necessarily to scale.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, an embodiment is an example or implementation. The various appearances of "one embodiment", "an embodiment" or "some embodiments" do not necessarily all refer to the same embodiments. Although various features may be described in the context of a single embodiment, the features may also be provided separately or in any suitable combination. Conversely, although the invention may be described herein in the context of separate embodiments for clarity, it may also be implemented in a single embodiment. Reference in the specification to "some embodiments", "an embodiment", "one embodiment" or "other embodiments" means that a particular feature, structure, or characteristic described in connection with the embodiments is included in at least some embodiments, but not necessarily all embodiments.

It is to be understood that the phraseology and terminology employed herein is not to be construed as limiting and are for descriptive purpose only. The principles and uses of the teachings of the present disclosure may be better understood with reference to the accompanying description, figures and examples. It is to be understood that the details set forth herein do not construe a limitation to an application of the disclosure.

Furthermore, it is to be understood that the disclosure can be carried out or practiced in various ways and that the disclosure can be implemented in embodiments other than the ones outlined in the description above. It is to be understood that the terms "including", "comprising", and grammatical variants thereof do not preclude the addition of one or more components, features, steps, or integers or groups thereof and that the terms are to be construed as specifying components, features, steps or integers. If the specification or claims refer to "an additional" element, that does not preclude there being more than one of the additional element. Where the claims or specification refer to "a" or "an" element, such reference should not be understood as meaning that there is only one of that element. It is to be understood that where the specification states that a component, feature, structure, or characteristic "may", "might", "can" or "could" be included, that particular component, feature, structure, or characteristic is not required to be included.

The descriptions, examples, methods and materials presented in the claims and the specification are not to be construed as limiting but rather as illustrative only. Meanings of technical and scientific terms used herein are to be commonly understood as by one of ordinary skill in the art to which the invention belongs, unless otherwise defined. It will be appreciated that the methods described herein may be performed in the described order, or in any suitable order.

Figure 2:
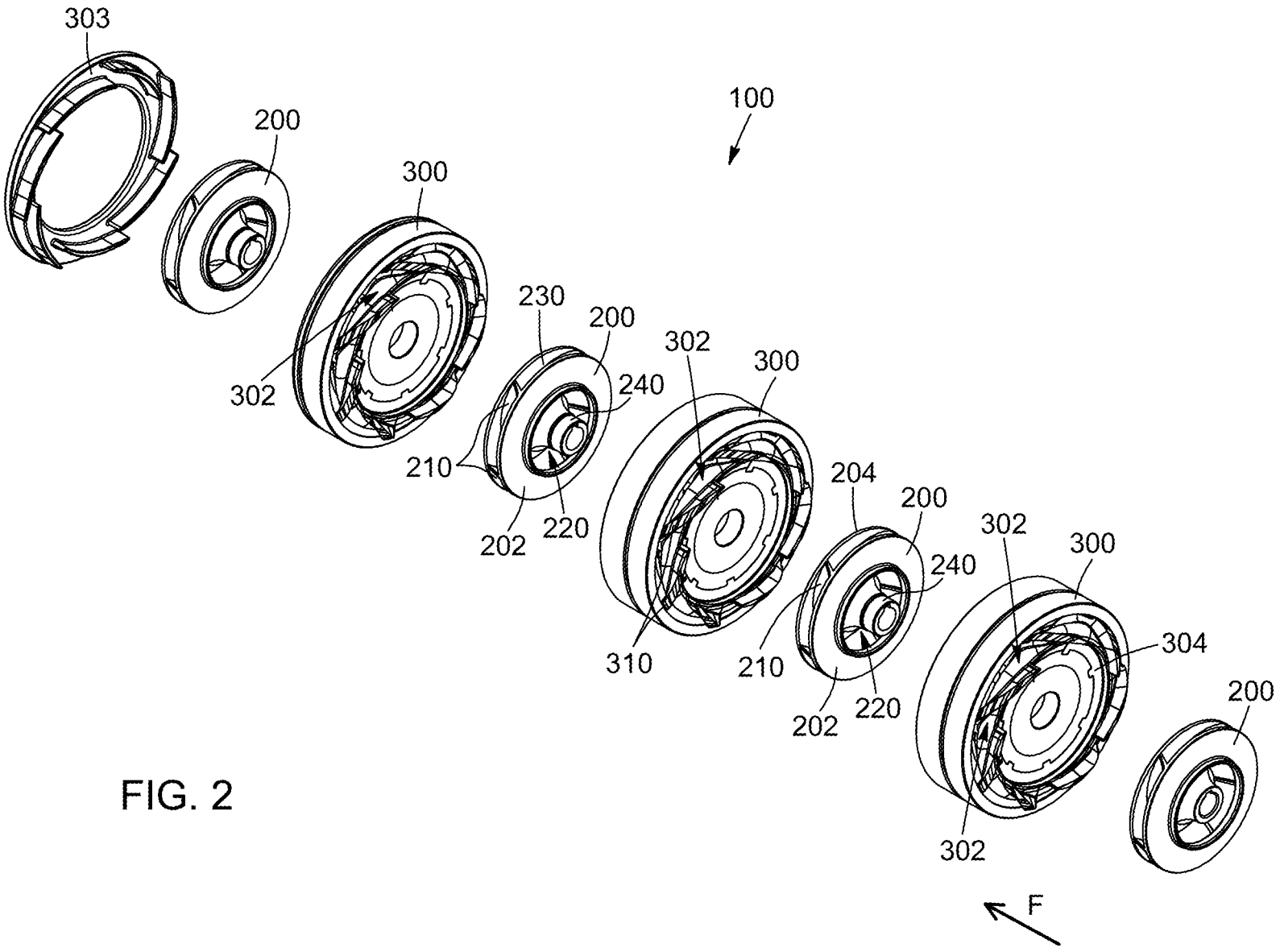
FIG. 2 is an upstream partially exploded view of the centrifugal pump of FIG. 1, the outer housing and the pump shaft thereof being removed.
Figure 3:
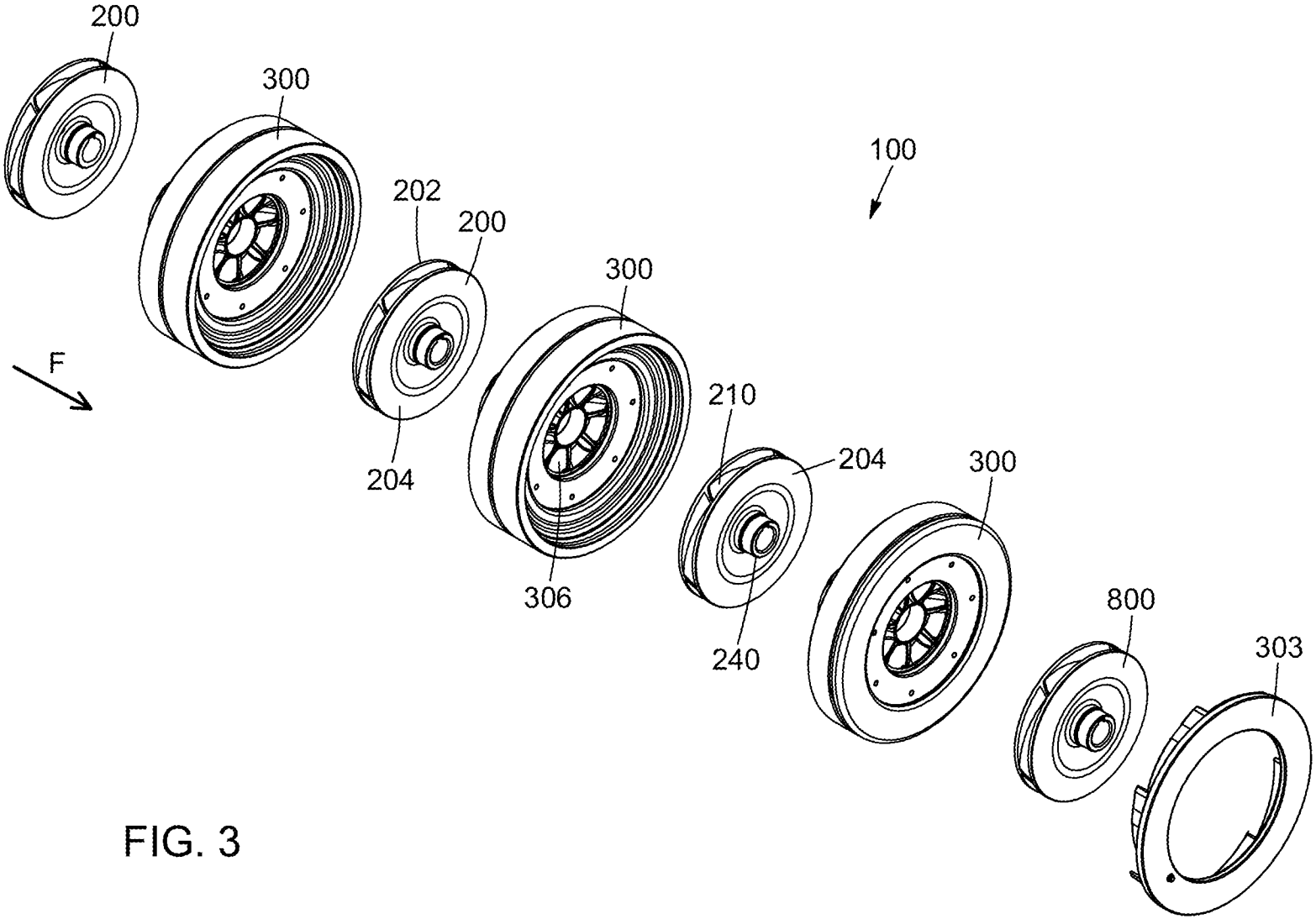
FIG. 3 is a downstream partially exploded view of the centrifugal pump of FIG. 1, the outer housing and the pump shaft thereof being removed.
Figure 5:
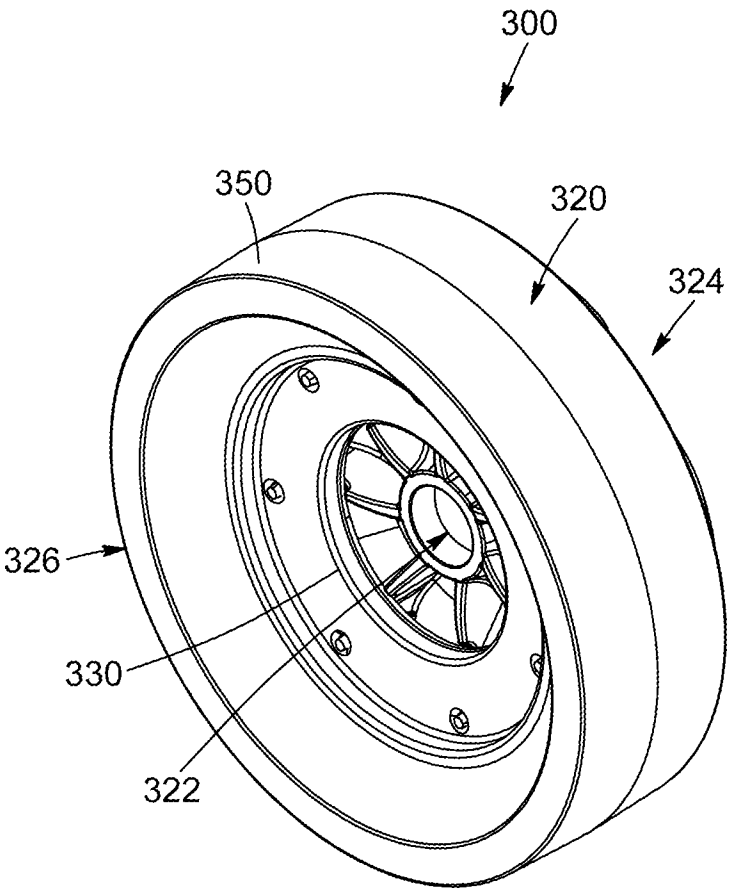
FIG. 5 is a downstream perspective view of the composite diffuser of FIG. 4.
Figure 4:
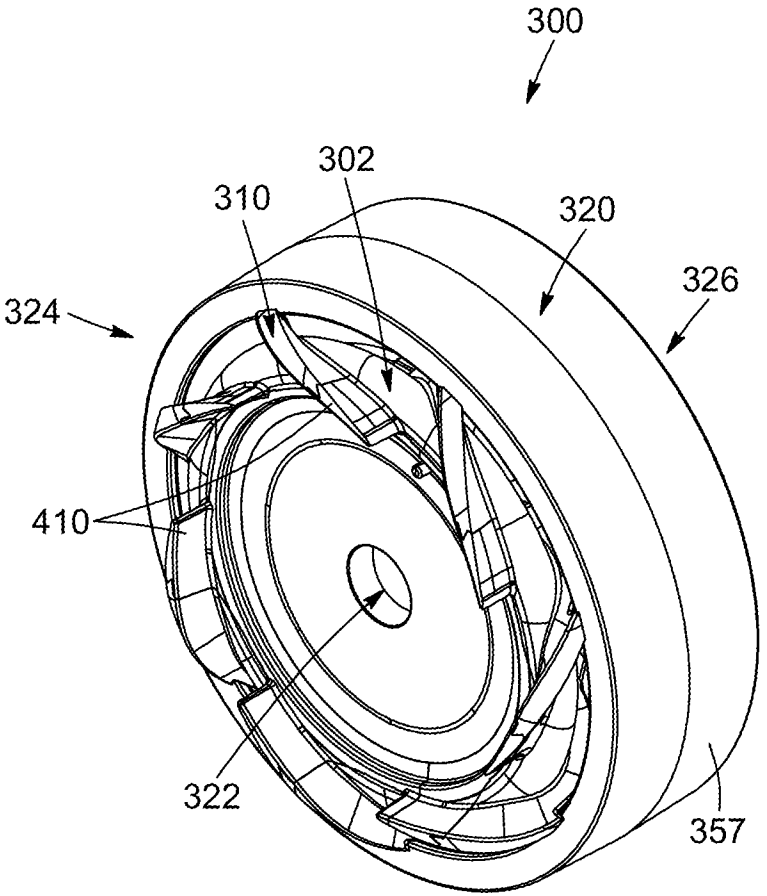
FIG. 4 is an upstream perspective view of one of the composite diffusers of FIG. 1, the composite diffuser comprising a casing-mounting member and a composite diffuser core.

Referring now to the drawings, and more particularly to FIGS. 1 to 3, there is shown a centrifugal pump 100 (for instance a multi-staged centrifugal pump 100). Such pumps can be used, for instance and without being limitative, as fire pumps.

As best shown in FIG. 1, the centrifugal pump 100 comprises an outer housing 102 (or pump casing 102 or casing 102) that is generally circular in cross-section and extends between a first longitudinal end 104, comprising a fluid inlet 105, and a second longitudinal end 106. The pump 100 comprises a shaft 110 (or drive shaft 110) rotatably mounted within a pump cavity at least partially delimited by an inner surface of the pump casing 102 and operatively coupled to a motor 112 arranged for instance at the second longitudinal end 106. The motor 112 is configured to rotate the shaft 110 about a pump axis X (or longitudinal axis X). The shaft 110 extends along the pump axis X.

In the embodiment shown, the centrifugal pump 100 further comprises a fluid outlet 120 formed in the housing 102 between the first and second longitudinal ends 104, 106.

In the following description, unless otherwise stated, the terms upstream and downstream should be understood with respect to a fluid circulation F within the pump cavity of the pump housing 102 upon actuation of the centrifugal pump 100, the fluid circulating from the fluid inlet 105 toward the fluid outlet 120.

The centrifugal pump 100 comprises a plurality of stages, wherein each stage comprises an impeller 200 and a diffuser 300. Generally, the impellers 200 are fixedly mounted to the drive shaft 110 and rotate therewith upon actuation of the motor 112. The rotating impellers 200 thus impart motion to a fluid introduced in the pump cavity of the pump housing 102 via the fluid inlet 105 and move the fluid from one stage to the next until the fluid is discharged through the fluid outlet 120. As best shown in FIGS. 2 and 3, the centrifugal pump 100 further comprises a downstream outlet-bordering diffuser 303, arranged so that the impeller 200 proximate the fluid outlet 120 is at least partially enclosed (or sandwiched) between one of the diffusers 300 and the downstream outlet-bordering diffuser 303.

In the embodiment shown, the impellers 200 have a substantially similar shape, so that the following description of one of the impellers 200 will apply to any of them.

Rotating Impellers

For instance and as best shown in FIGS. 2 and 3, the impeller 200 comprises a series of curved impeller vanes 210 that are sandwiched between two impeller disks 202, 204 (or upstream and downstream impeller disks 202, 204). The fluid enters the impeller 200 at an eye 220 thereof and exits along a circumference 230 (or outer periphery 230) of the impeller 200 between adjacent ones of the plurality of impeller vanes 210. As mentioned above, the impeller 200 is connected through the drive shaft 110 to the motor 112 and is rotated about the pump axis X upon actuation of the motor 112. The rotational motion of the impeller 200 accelerates the fluid out through the impeller vanes 210 toward the circumference 230.

Diffusers

In the embodiment shown, the diffusers 300 have a substantially similar shape, so that the following description of one of the diffusers 300 will apply to any of them.

The diffuser 300 is rotationally stationary within the pump cavity of the pump casing 102 (or pump outer housing 102) (i.e., is fixedly mounted to the pump casing 102, for instance to the internal surface thereof at least partially delimiting the pump cavity) and is shaped and dimensioned to guide (i.e., direct) the fluid from an upstream impeller 200 to the next impeller.

As detailed below and as shown for instance in FIGS. 2 and 3, the diffuser 300 comprises a plurality of diffuser vanes 310 at least partially delimiting diffuser flow passages 302 between two adjacent diffuser vanes 310 (or fluid-directing paths 302) from an upstream side 304 to a downstream side 306 thereof. The diffuser vanes 310 are shaped and dimensioned to surround radially at least partially the impeller 200 (for instant the impeller vanes 210 thereof). It is known that a fluid pressure increases as the fluid is expelled between a set of stationary diffuser vanes 310 surrounding the corresponding rotating impeller 200. The diffuser 300 is configured to circulate the fluid from the circumference 230 of an upstream impeller 200 into the eye 220 of the following adjacent downstream impeller 200.

In the embodiment shown, the centrifugal pump 100 comprises four rotating impellers 200 and three diffusers 300 fixedly mounted to the casing 102 of the pump 100, but the disclosure is obviously not limited to a centrifugal pump having three diffusers and four impellers.

Composite Diffuser

In the embodiment shown, the diffuser 300 (or cross-over diffuser 300) is a composite diffuser (or composite cross-over diffuser) and comprises a diffuser housing assembly 320 at least partially delimiting an impeller shaft-receiving opening 322 and having upstream 324 and downstream sides 326.

For instance, the diffuser housing assembly 320 is at least partially formed in a first material, such as a composite material (for instance and without being limitative a composite material composed of polyphenylene sulfide (PPS) and glass fiber (GF) in different possible ratios). The diffuser vanes 310 are mounted to or formed integral with the upstream side 324 of the diffuser housing assembly 320 and protrude (in a substantially axial direction, when the diffuser is mounted to the pump casing 102) therefrom. At least one of the plurality of vanes 310 comprises a reinforcing vane portion 410 formed in a second material different from the first material.

In other words, the composite diffuser 300 comprises a casing-mounting member 350 having the impeller shaft-receiving opening 322 and comprising a core-supporting portion 352 bordering at least partially the impeller shaft-receiving opening 322. The composite diffuser 300 further comprises a composite diffuser core 400 secured to or at least partially formed integral with the core-supporting portion 352 of the casing-mounting member 350.

In yet other words, the composite diffuser 300 is at least partially formed of two distinct materials. For instance, an inner tip portion of at least one of the plurality of diffuser vanes 310 (of an upstream vane member thereof) is formed in a material having heat-resisting properties greater than a material in which a remaining portion of the composite diffuser 300 is formed.

As detailed below, the composite diffuser core 400 comprises a core body 420 being at least partially formed in the first material and having upstream and downstream faces 422, 424. The plurality of vanes 310 (or diffuser vanes 310) are mounted to or formed integral with the core body 420

(for instance with the upstream face 422 thereof) and protrude therefrom. At least one of the plurality of vanes 310 comprises the reinforcing vane portion 410 formed in the second material.

As detailed below, the reinforcing vane portions 410 provide an added strength to the composite cross-over diffuser 300 to resist mechanical loads and/or pressure loads. For instance, the reinforcing vane portions 410 are shaped and dimensioned to resist a temperature increase within the pump cavity of the pump casing 102, for instance in case of a sudden shutting off of the pump 100. In some embodiments, a temperature of the fluid within the pump casing can be greater than about 100° C. In some embodiments, the temperature of the fluid within the pump casing can greater than about 120° C. In some embodiments, the temperature of the fluid within the pump casing can greater than about 150° C. In some other embodiments, the temperature of the fluid within the pump casing can greater than about 200° C.

As best shown in FIGS. 4 to 8, the casing-mounting member 350 of the composite cross-over diffuser comprises a hub portion 330 having the impeller shaft-receiving central opening 322 formed therein, the central opening 322 being dimensioned to rotatably receive a shaft-engaging sleeve 240 of the next adjacent impeller 200.

The casing-mounting member 350 further comprises the core-supporting portion 352 extending from the hub portion 330 to a peripheral casing-mounting outer ring 354. For instance, considered in a radial direction and starting from a central axis of the casing-mounting member 350, the hub portion 330, the core-supporting portion 352 and/or the peripheral casing-mounting outer ring 354 are formed integral with each other so that a continuity is formed between the different portions of the casing-mounting member 350. For instance, the plurality of diffuser flow passages 302 are formed on the upstream side 304 of the composite diffuser 300 for directing the fluid in the direction of arrows 301 (FIG. 6) as the fluid moves from an upstream impeller to the next sequential downstream impeller.

In the embodiment shown, the diffuser housing assembly 320 comprises the casing-mounting member 350 and the core body 420 of the composite diffuser core 400.

Casing-Mounting Member

Figure 7:
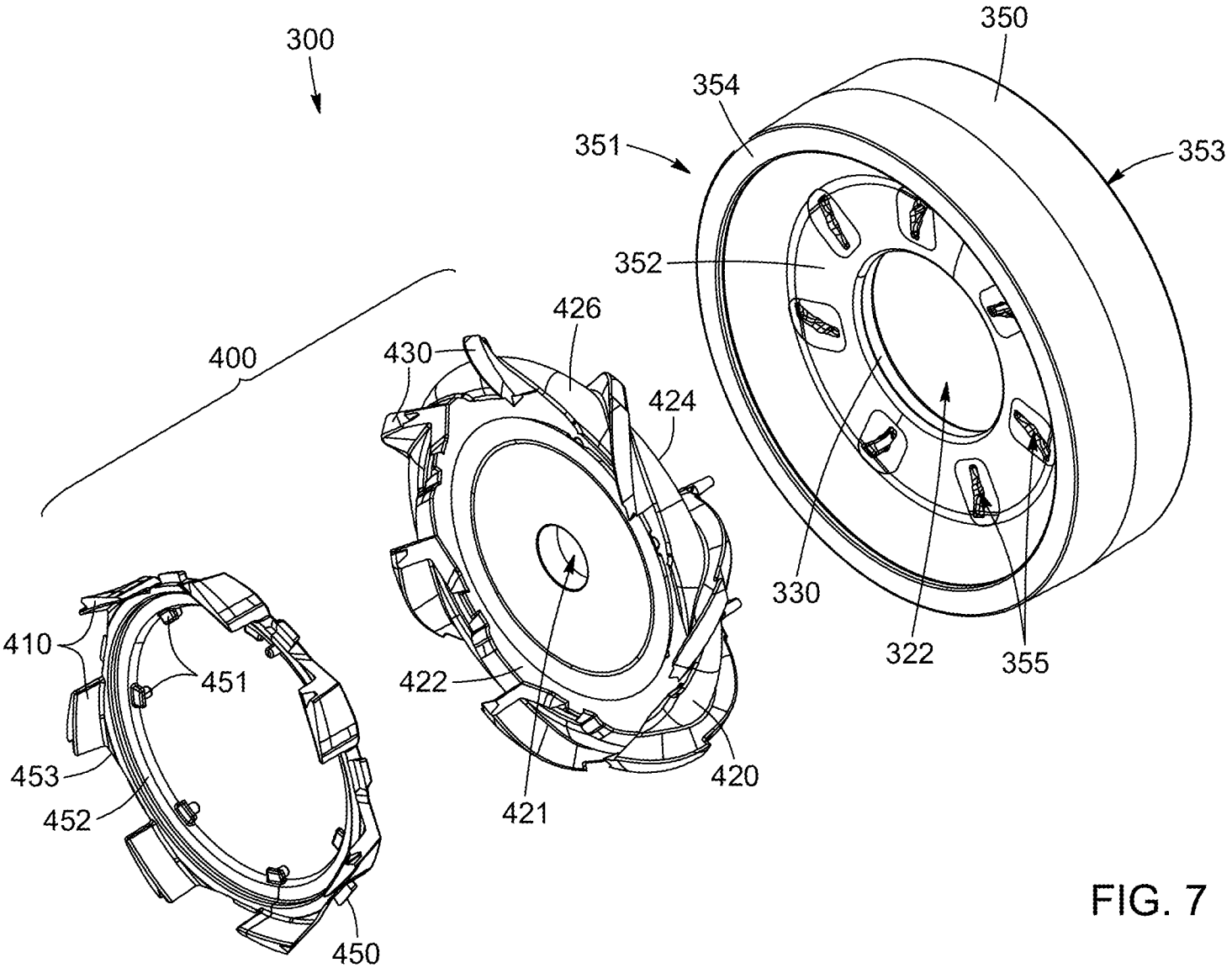
FIG. 7 is an upstream perspective view, exploded, of the composite diffuser of FIG. 4.
Figure 8:
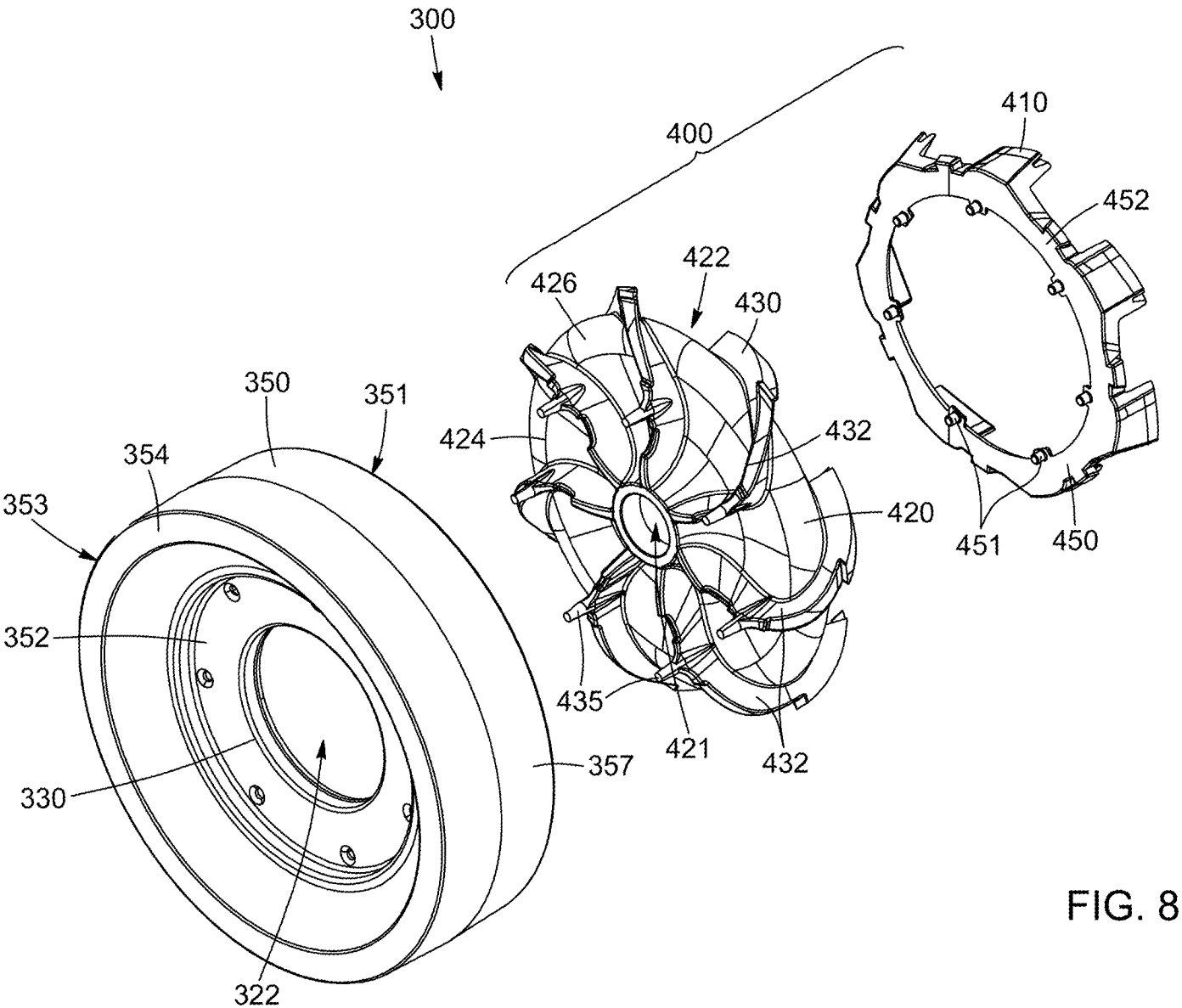
FIG. 8 is a downstream perspective view, exploded, of the composite diffuser of FIG. 4.

As best shown in FIGS. 7 and 8, the casing-mounting member 350 has upstream and downstream sides 351, 353, forming respectively at least partially the upstream and downstream sides 304, 306 of the composite diffuser 300 when the different components of the composite diffuser 300 are assembled together.

The above-mentioned peripheral ring 354 (or peripheral casing-mounting outer ring 354) is substantially cylindrical with an axis corresponding substantially to the pump axis X when the centrifugal pump 100 is assembled. An outer surface 357 of the peripheral casing-mounting outer ring 354 is configured to face and to be assembled to an inner surface of the pump casing 102 (FIG. 1) to fixedly mount the composite diffuser 300 (for instance via the casing-mounting member 350 thereof) to the pump casing 102.

For instance, a plurality of core-receiving apertures 355 are formed in the upstream side 351 of the casing-mounting member 350 (for instance in an upstream side of the core-supporting portion 352).

It is appreciated that the shape, the configuration of the casing-mounting member 350, and the shape, the configuration and/or the location of the components thereof can vary from the embodiment shown.

Composite Diffuser Core

In the embodiment shown, and as represented for instance in FIGS. 7 to 11, the composite diffuser core 400 comprises at least two components, namely the core body 420 and a vane-reinforcing assembly 450 comprising a plurality of the above-mentioned reinforcing vane portion 410.

Figure 6:
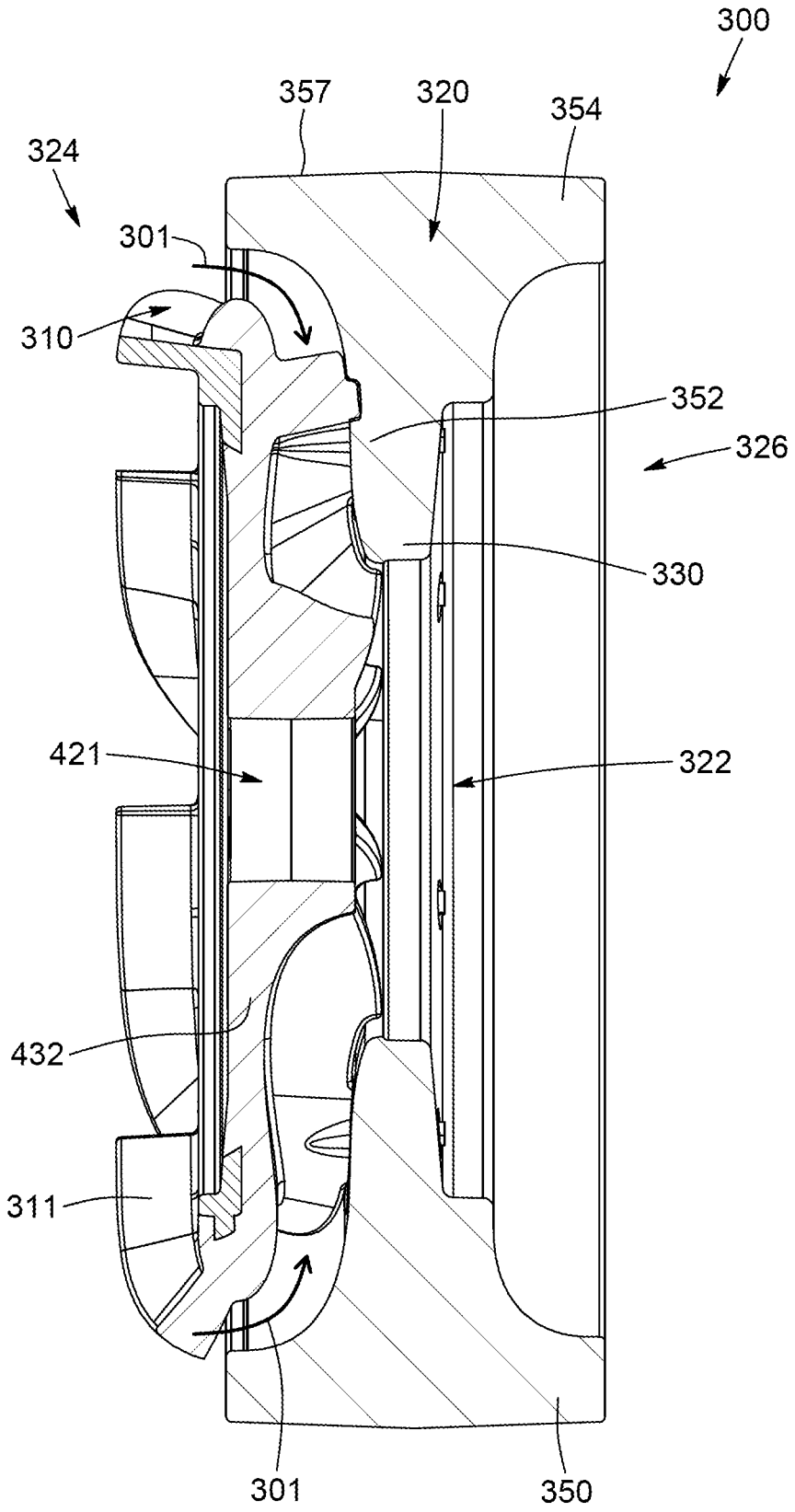
FIG. 6 is a cross-sectional view of the composite diffuser of FIG. 4.

The core body 420 is shaped and dimensioned to extend at least partially in the impeller shaft-receiving opening 322 formed in the casing-mounting member 350. A sleeve-receiving central opening 421 is formed in the core body 420 which is shaped and dimensioned to receive at least partially the shaft-engaging sleeve 240 of the adjacent impeller 200. As best shown in FIG. 6, the impeller shaft-receiving opening 322 and the sleeve-receiving central opening 421 are in fluid communication with each other, with the sleeve-receiving central opening 421 of the core body 420 having dimensions (for instance a diameter) smaller than dimensions (for instance a diameter) of the impeller shaft-receiving opening 322. It is thus understood that, in the embodiment shown, the axial and/or radial position of the composite diffuser 300 within the pump casing 102 is at least partially determined by the dimensions of the sleeve-receiving central opening 421.

The downstream face 424 of the core body 420 is configured to face the upstream side 351 of the casing-mounting member 350 when assembled together, whereas the upstream face 422 at least partially forms the upstream side 304 of the composite diffuser 300.

The core body 420 comprises a core plate 426 extending transversally (for instance substantially perpendicularly) to the pump axis X when the pump 100 is assembled. The core plate 426 forms at least partially the upstream and downstream faces 422, 424 of the core body 420.

Figure 10:
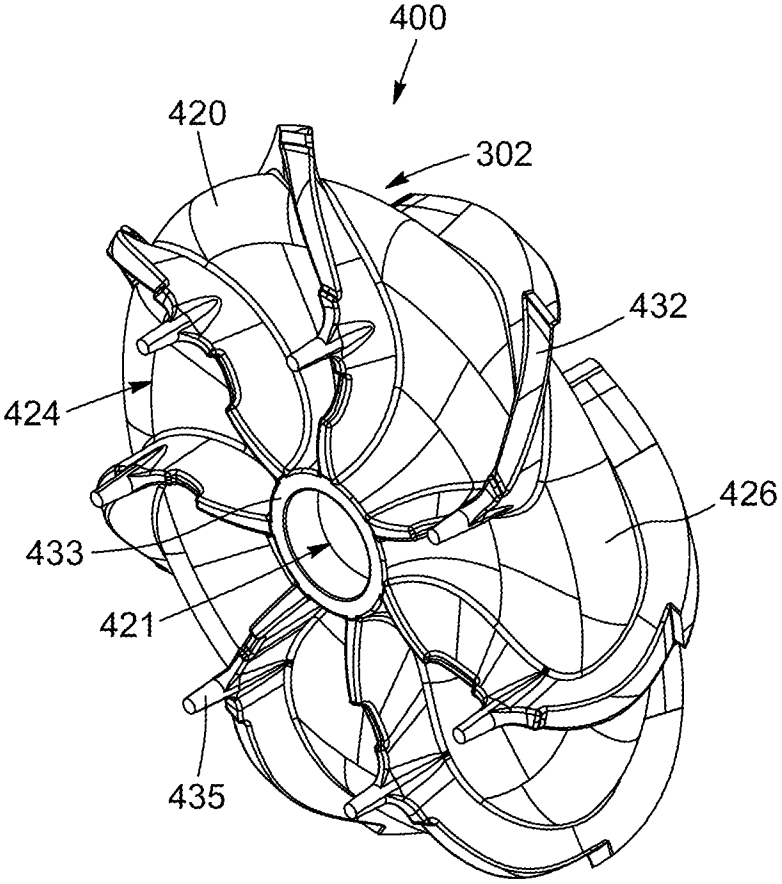
FIG. 10 is a downstream perspective view of the composite diffuser core of FIG. 9.

The core body 420 further comprises a plurality of distal upstream vane portions 430 mounted to or formed integral with an upstream face of the core plate 426. The core body 420 further comprises a plurality of downstream vane members 432 mounted to or formed integral with a downstream face of the core plate 426. As best shown in FIG. 10, the downstream vane members 432 extend at least partially, in a radial direction, between the outer perimeter of the core plate 426 and an inner perimeter 433 thereof at least partially bordering the sleeve-receiving central opening 421.

As best shown in FIGS. 7 to 11, the distal upstream vane portions 430 are connected with a corresponding one of the downstream vane members 432 so as to form a continuity therewith extending radially over the outer perimeter of the core plate 426. In other words, the combination of the plurality of distal upstream vane portions 430 and the plurality of downstream vane members 432 at least partially delimit the plurality of diffuser flow passages 302 to allow a fluid circulation from the upstream side 304 of the composite diffuser 300 to the downstream side 306 thereof.

As best shown in FIG. 8, the core body 420 comprises a plurality of diffuser housing-mounting pins 435 which are mounted to or formed integral with, for instance, the downstream face of the core plate 426. The diffuser housing-mounting pins 435 are shaped and dimensioned to be at least partially engaged with the core-receiving apertures 355 of the casing-mounting member 350, to contribute to the accuracy of the arrangement of the composite diffuser core with respect to the casing-mounting member 350 prior to their securing to each other.

As best shown in FIGS. 7 and 8, the vane-reinforcing assembly 450 comprises a core body-mounting ring 452 and a plurality of reinforcing vane portions 410 protruding outwardly (considered in a radial direction) from the core body-mounting ring 452. The plurality of reinforcing vane portions 410 extend from an upstream face 453 of the core body-mounting ring 452. In the embodiment shown, the plurality of reinforcing vane portions 410 are configured to form proximal upstream vane portions of the plurality of vanes 310 of the composite diffuser 300. In the embodiment shown, the vane-reinforcing assembly 450 further comprises a plurality of body-mounting pins 451 that are shaped and dimensioned to ease the mounting of the vane-reinforcing assembly 450 to the core body 420 in order to form therewith the composite diffuser core 400. For instance, the body-mounting pins 451 are mounted to or formed integral with an inner border of the core body-mounting ring 452 but any other means to secure the vane-reinforcing assembly 450 to the core body 420 could be considered.

In the present disclosure, unless otherwise stated, the terms distal and proximal should be understood relative to the pump axis X when the different components of the centrifugal pump 100 are assembled together, in a substantially radial direction within the pump cavity of the pump casing.

Figure 9:
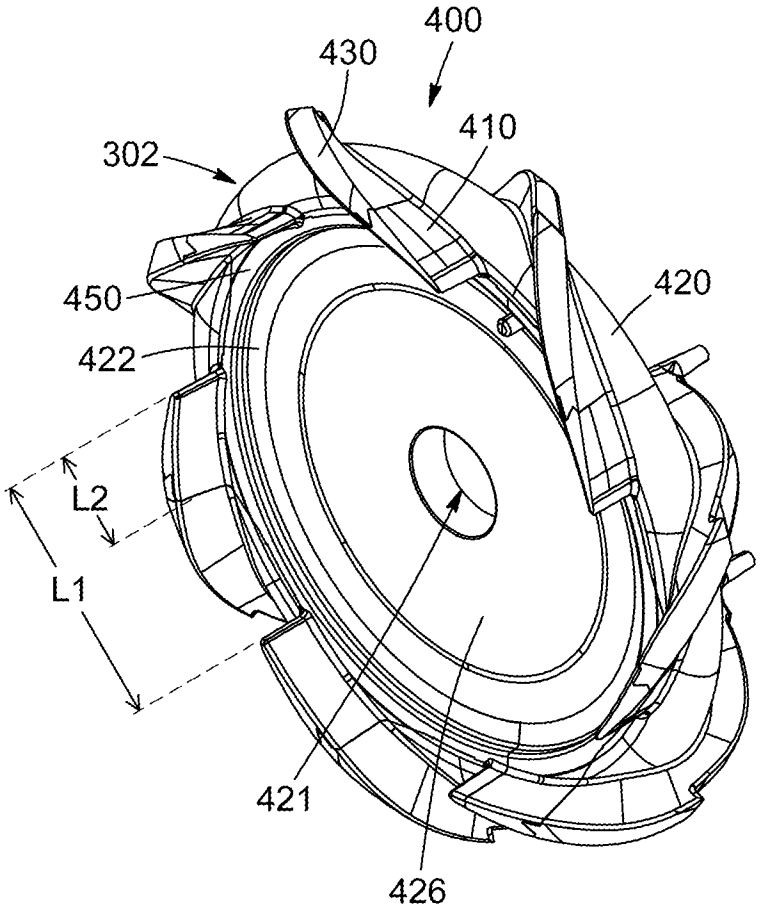
FIG. 9 is an upstream perspective view of the composite diffuser core of the composite diffuser of FIG. 4.
Figure 11:
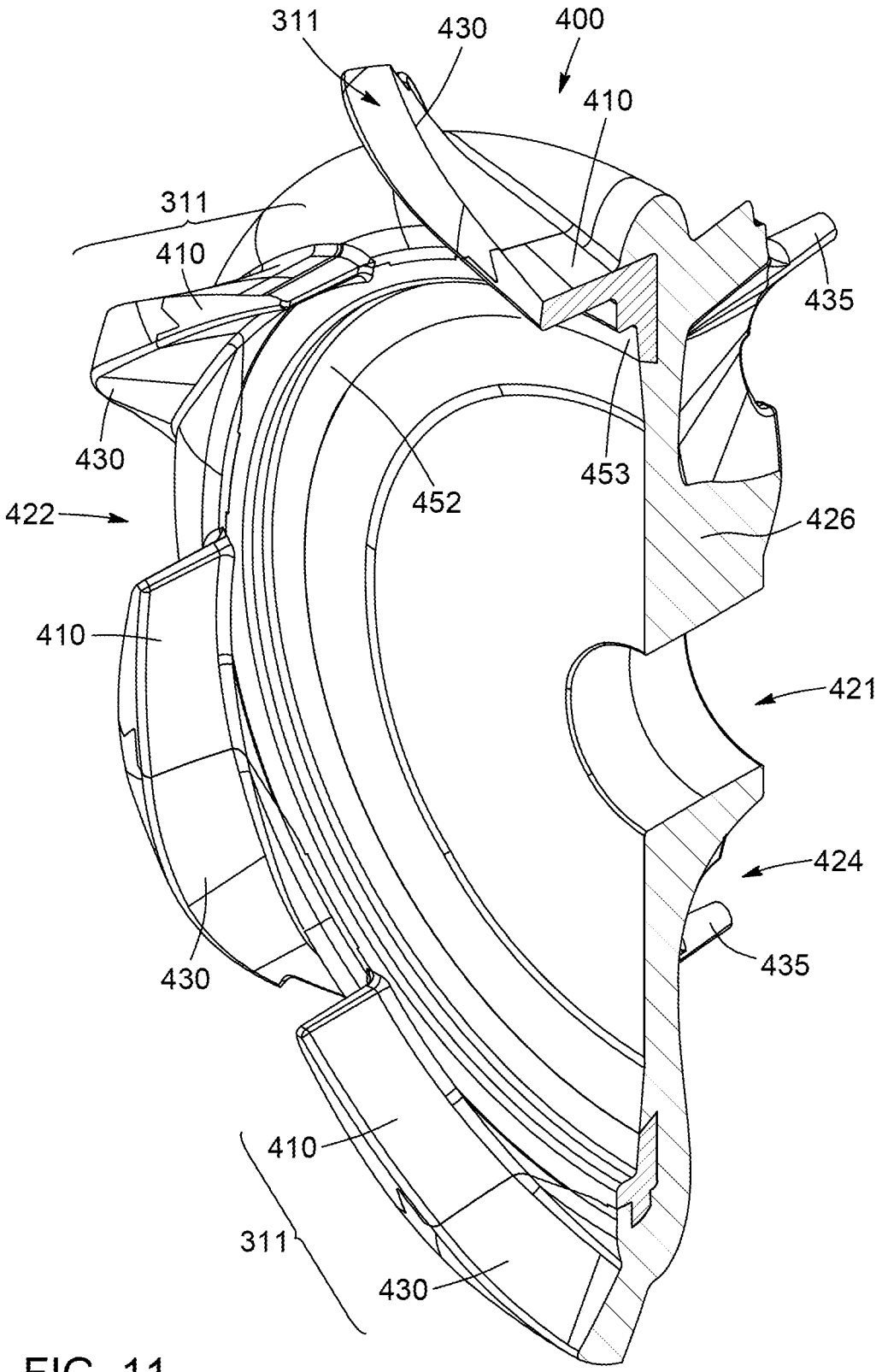
FIG. 11 is a partially sectioned view of the composite diffuser core of FIG. 9.

As best shown in FIGS. 9 to 11, the vane-reinforcing assembly 450 and the core body 420 are configured to be assembled so as to form together the composite diffuser core 400. The vane-reinforcing assembly 450 forms at least partially the upstream side 304 of the composite diffuser 300 when assembled with the casing-mounting member 350.

It is understood that each of the plurality of vanes 310 comprises an upstream vane member 311 and a downstream vane member formed at least partially by the downstream vane member 432 of the core body 420, the upstream and downstream vane members being connected to each other so as to form a continuity together extending radially over an outer perimeter of the core plate 426 and thus at least partially delimiting the fluid-directing path from the upstream side 304 of the composite diffuser 300 towards the downstream side 306 thereof. In other words, the diffuser vanes 310 are shaped and dimensioned to direct the fluid over (considered in a radial direction) the composite diffuser core 400.

As best shown in FIGS. 9 to 11, the upstream vane member 311 of the composite diffuser 300 is at least partially formed by a combination of the vane portion 410 (or proximal reinforcing vane portion) of the vane-reinforcing assembly 450 and the distal upstream vane portion 430 of the core body 420. The vane portions 410 of the vane-reinforcing assembly 450 are shaped and dimensioned to form at least partially a tip portion (or proximal portion, or inner tip portion) of a corresponding one of the diffuser vanes 310 (a tip portion of the upstream vane member 311 of the corresponding one of the diffuser vanes 310). In the embodiment shown, the upstream vane member 311 extends along more than about 5% of a radius of the composite diffuser 300 when the composite diffuser core 400 is assembled with the casing-mounting member 350. In some embodiments, the upstream vane member 311 extends along more than about 15% of the radius of the composite diffuser 300 when the composite diffuser core 400 is assembled with the casing-mounting member 350. In yet some other embodiments, the upstream vane member 311 extends along more than about 20% of the radius of the composite diffuser 300 when the composite diffuser core 400 is assembled with the casing-mounting member 350.

In other words, the plurality of diffuser vanes 310 delimit the plurality of diffuser flow passages 302 or fluid-directing paths 302 between the upstream and downstream faces 422, 424 of the core body 420 of the composite diffuser core 400 so that the composite diffuser is of the cross-over type.

As best shown in FIG. 9, a length l2 of the vane portion 410 forms at least about 15% of a length l1 of the corresponding upstream vane member 311. In some embodiments, the vane portion 410 forms at least about 30% of the length of the corresponding upstream vane member 311. In some embodiments, the vane portion 410 forms at least about 40% of the length of the corresponding upstream vane member 311. In yet some other embodiments, the vane portion 410 forms at least about 50% of the length of the corresponding upstream vane member 311.

As best shown in FIGS. 9 to 11, the reinforcing vane portions 410 might be at least partially over-molded onto the distal upstream vane portion 430 of the core body 420. Since the reinforcing vane portions 410 are in the second material which is different from the first material in which the casing-mounting member 350 and/or the core body 420 are at least partially formed, the tip portions of the diffuser vanes 310 (of the upstream vane members 311 thereof) are prevented from bending during extreme usage conditions or shut-off conditions of the centrifugal pump 100.

For instance, the second material comprises aluminum, such as marine grade aluminum, or any other material suitable to resist high temperatures, for instance any other moldable material having heat-resisting properties and/or having corrosion-resisting properties. The use of a material having heat-resisting properties and/or corrosion-resisting properties to form at least partially a vane portion (or tip portion) of the plurality of vanes (for instance an inner tip portion of at least one of the plurality of diffuser vanes) is particularly adapted since the vane portions (for instance the inner tip portions) of the diffuser vanes might undergo high load and/or high temperature when in use. It is understood that the diffuser vanes (for instance the inner tip portions thereof) are shaped (for instance have a sharp and/or thin profile) and dimensioned for an optimal hydraulic efficiency of the diffuser when in use.

The use of two distinct materials to form the composite diffuser 300 allows to limit an overall weight of the composite diffuser, and thus an overall weight of the corresponding centrifugal pump. Moreover, the materials can be specifically adapted to different constraints undergone by the composite diffuser 300. For instance, the use of the first material to form at least partially the diffuser housing assembly 320 (for instance to form at least partially the casing-mounting member 350 and the core body 420 of the composite diffuser core 400) provides a cross-over diffuser defining accurate radial and/or axial gaps with the other components of the centrifugal pump when assembled together. Moreover, the use of distinct materials to form different components of the composite diffuser 300 contributes to the compactness of the diffuser while limiting overall weight and/or production cost of the composite diffuser.

It is understood that in the embodiment shown, for instance via the engagement of the diffuser housing-mounting pins 435 of the composite diffuser core 400 with the core-receiving apertures 355 formed in the casing-mounting member 350, the different elements of the composite diffuser 300 are secured together substantially axially (i.e., along a direction substantially parallel to the pump axis X and/or along a direction substantially parallel to a central axis of the casing-mounting member and/or the composite diffuser core).

It is thus understood that the composite diffuser 300 comprises reinforcing members forming, in the embodiment shown, at least partially the inner tip portions of the upstream vane members of the plurality of diffuser vanes 310. The disclosure is obviously not limited to reinforcing members forming only at least partially the inner tip portions of the upstream vane members and reinforcing members could also form at least partially any other portions of the composite diffuser, either via other parts of the vane-reinforcing assembly or via reinforcing pieces mounted to or formed integral with or over molded onto said other portions of the composite diffuser.

It is appreciated that the shape and the configuration of the composite diffuser core, as well as the shape, the configuration and/or the location of the core body and the vane-reinforcing assembly thereof, can vary from the embodiment shown.

For instance, even though in the embodiment shown the reinforcing vane portions 411 are mounted to or formed integral with a core body-mounting ring 452 to form together the vane-reinforcing assembly 450, it could be conceived a composite diffuser wherein reinforcing vane portions would be directly over molded onto parts of the core body of the diffuser core and/or onto parts of the diffuser housing assembly.

For instance, the shape and dimensions of the diffuser vanes 310 (for instance of the upstream vane members thereof comprising the reinforcing vane portion 410 of the vane-reinforcing assembly 450 and the distal upstream vane portion 430 of the core body 420 and/or of the downstream vane members thereof) depends on shapes and dimensioned of the impellers configured to be at least partially surrounded by the corresponding composite diffuser.

The present disclosure is not limited to a composite diffuser comprising seven diffuser vanes and/or being at least partially formed by two distinct materials.

Process for Manufacturing a Composite Diffuser

According to another aspect of the disclosure, there is provided a process for manufacturing a composite diffuser comprising diffuser vanes at least partially formed of two distinct materials. For instance, an inner tip portion of at least one of the plurality of diffuser vanes is formed in a material having heat-resisting properties greater than a material in which a remaining portion of the composite diffuser is formed.

For instance, the process comprises a step of providing a core body 420 having an upstream face 422, the core body being formed in a first material; a step of providing a vane-reinforcing assembly 450 formed in a second material; a step of securing the vane-reinforcing assembly 450 to the upstream face 422 of the core body 420 to form together a composite diffuser core 400; a step of providing a casing-mounting member 350 of a diffuser housing assembly 320; and a step of securing the composite diffuser core 400 to the casing-mounting member 350.

In the embodiment shown, the composite diffuser core 400 is welded (for instance via sonic welding or ultra-sonic welding) to a core-supporting portion 352 of the casing-mounting member 350. For instance, the process comprises engaging diffuser housing-mounting pins 435 mounted to or formed integral with a downstream face of a core plate 426 of the core body 420 with core-receiving apertures 355 formed in an upstream side 351 of the casing-mounting member 350. It is however understood that the present disclosure is not limited to a composite diffuser core that would be welded to the casing-mounting member; the core body of the composite diffuser core and the casing-mounting member could be assembled together using a different method, such as for instance and without being limitative infrared welding, screws, rivets and the like. The composite diffuser core could alternatively be not secured to the casing-mounting member.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited by the scope of the appended claims.

What is claimed is:

1. A composite cross-over diffuser for a centrifugal pump, the composite cross-over diffuser comprising: a plurality of composite upstream vane members at least partially delimiting diffuser flow passages between two adjacent upstream vane members, a diffuser housing assembly at least partially delimiting an impeller shaft-receiving opening and being at least partially formed in a first material, the diffuser housing assembly having a core body with upstream and downstream faces, the core body having a plurality of distal upstream vane portions of the plurality of composite upstream vane members mounted to or formed integral with the upstream face of the core body, the plurality of distal upstream vane portions being formed in the first material; and a vane-reinforcing assembly comprising a plurality of reinforcing vane portions mounted to or formed integral with the diffuser housing assembly and protruding therefrom, the plurality of reinforcing vane portions being formed in a second material different from the first material and forming proximal upstream vane portions of the plurality of composite upstream vane members.

2. The composite cross-over diffuser of claim 1, wherein the diffuser housing assembly further comprises a casing-mounting member comprising a hub portion delimiting at least partially the impeller shaft-receiving opening and a core-supporting portion radially and outwardly extending from the hub portion to a peripheral casing-mounting outer ring of the casing-mounting member, the core body being mounted to or formed integral with the casing-mounting member, wherein at least two of the hub portion, the core-supporting portion and the peripheral casing-mounting outer ring are formed integral with each other.

3. The composite cross-over diffuser of claim 2, wherein a plurality of core-receiving apertures are formed in an upstream side of the core-supporting portion, wherein the core body comprises a plurality of diffuser housing-mounting pins mounted to or formed integral with the downstream face of the core body, wherein the plurality of diffuser housing-mounting pins are shaped and dimensioned to be at least partially engaged with the plurality of core-receiving apertures of the core-supporting portion of the casing-mounting member to secure the core body to the casing-mounting member.

4. The composite cross-over diffuser of claim 1, wherein a length of each reinforcing vane portion forms at least about 15% of a length of the corresponding composite upstream vane member.

5. The composite cross-over diffuser of claim 1, wherein the core body comprises a core plate extending transversally to a pump axis of the centrifugal pump when the centrifugal pump is assembled and forming at least partially the upstream and downstream faces of the core body, wherein a sleeve-receiving opening is formed in the core body in fluid communication with the impeller shaft-receiving opening, wherein the core body comprises a plurality of downstream vane members mounted to or formed integral with the downstream face of the core plate, wherein the downstream vane members extend radially at least partially between an outer perimeter of the core plate and an inner perimeter of the core plate at least partially bordering the sleeve-receiving central opening and wherein each distal upstream vane portion is connected with a corresponding one of the downstream vane members so as to form a continuity therewith extending radially over the outer perimeter of the core plate, wherein a combination of the plurality of upstream vane members and the plurality of downstream vane members at least partially form a plurality of vanes delimiting the diffuser flow passages to allow a fluid circulation from an upstream side of the composite cross-over diffuser to a downstream side thereof.

6. The composite cross-over diffuser of claim 1, wherein the vane-reinforcing assembly comprises a core body-mounting ring, the plurality of reinforcing vane portions protruding outwardly from the core body-mounting ring and extending from an upstream face of the core body-mounting ring.

7. The composite cross-over diffuser of claim 1, wherein the first material comprises at least one of polyphenylene sulfide and glass fiber and wherein the second material comprises aluminum.

8. A multi-staged centrifugal fire pump comprising: an outer housing; a plurality of diffusers fixedly mounted to the outer housing; and a plurality of impellers rotatably mounted to the outer housing, at least one of the plurality of impellers being arranged between two adjacent diffusers; wherein at least one of the plurality of diffusers is a composite cross-over diffuser according to claim 1.

9. A composite cross-over diffuser for a centrifugal pump, the composite cross-over diffuser comprising: a casing-mounting member having an impeller shaft-receiving opening and comprising a core-supporting portion; and a composite diffuser core mounted to or at least partially formed integral with the core-supporting portion of the casing-mounting member; wherein the composite diffuser core comprises a plurality of upstream vane members; a core body at least partially formed in a first material and having upstream and downstream faces; and a vane-reinforcing assembly formed in a second material different from the first material, the vane-reinforcing assembly comprising a core body-mounting ring mounted to or formed integral with the upstream face of the core body and a plurality of reinforcing vane portions protruding outwardly from the core body-mounting ring and extending from an upstream face of the core body-mounting ring, wherein the plurality of reinforcing vane portions form proximal vane portions of the plurality of upstream vane members, wherein the core body has a plurality of distal upstream vane portions of the plurality of upstream vane members mounted to or formed integral with the upstream face of the core body, the plurality of distal upstream vane portions being formed in the first material and forming with the plurality of reinforcing vane portions the plurality of upstream vane members.

10. The composite cross-over diffuser of claim 9, wherein the plurality of reinforcing vane portions are shaped and dimensioned to form at least partially tip portions of the plurality of upstream vane members.

11. The composite cross-over diffuser of claim 9, wherein the first material comprises at least one of polyphenylene sulfide and glass fiber and wherein the second material comprises aluminum.

12. The composite cross-over diffuser of claim 9, wherein the vane-reinforcing assembly further comprises a plurality of body-mounting pins that are shaped and dimensioned to ease the mounting of the vane-reinforcing assembly to the core body in order to form therewith the composite diffuser core.

13. The composite cross-over diffuser of claim 12, wherein the body-mounting pins are mounted to or formed integral with an inner peripheral border of the core body-mounting ring.

* * * * *